US005645098A

United States Patent [19]

Morrill

[11] Patent Number: 5,645,098

[45] Date of Patent: Jul. 8, 1997

[54] LOW PROFILE AND LIGHTWEIGHT HIGH PRESSURE BLOWOUT PREVENTER

[75] Inventor: Charles D. Morrill, Humble, Tex.

[73] Assignee: Hydril Company, Houston, Tex.

[21] Appl. No.: 599,246

[22] Filed: Feb. 9, 1996

Related U.S. Application Data

[62] Division of Ser. No. 372,397, Jan. 13, 1995, abandoned.

[51] Int. Cl.[6] ..... E21B 33/06

[52] U.S. Cl. ..... 137/15; 166/85.4

[58] Field of Search ..... 251/1.1, 1.3; 166/85.1, 166/85.4, 92.1; 137/15

[56] References Cited

U.S. PATENT DOCUMENTS

| | | | |
|---|---|---|---|
| 3,658,287 | 4/1972 | Leromax | 251/1.3 |
| 4,253,638 | 3/1981 | Troxell, Jr. | 251/1.3 |

*Primary Examiner*—John C. Fox

*Attorney, Agent, or Firm*—Vaden, Eickenroht & Thompson L.L.P.

[57] ABSTRACT

A lightweight blowout preventer having a low profile is disclosed. Each of the rams have a sealing ring to be positioned thereabout to seal leaks from occurring between its bonnet and the ram body, thereby permitting the use of only about four connecting bolts for each side of the bonnet to the body and torqued for ordinary holding. A hinge plate is provided to allow selection of the side of the body for two associated bonnets. The hinge plate also is a manifold for the passageways for the hydraulic fluid to the fluid hinges. The hinges each includes a telescopic balancing sub with only one side spring for applying balanced pressure with the applied closing or opening hydraulic fluid to the hinge regardless of whether opening or closing hydraulic pressure is applied. The hydraulic passageways in the bonnets are located between the guideway extensions and the outside surfaces of the bonnets. The hinge plate and the bonnets can be inverted so that they can be mounted on either of two sides of the body.

3 Claims, 6 Drawing Sheets

FIG. 3
(PRIOR ART)
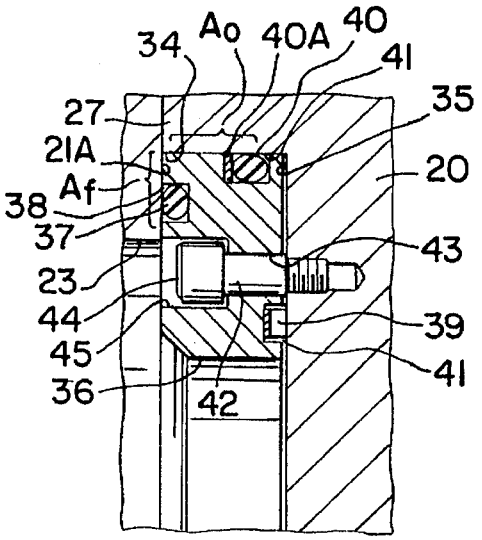
FIG. 11
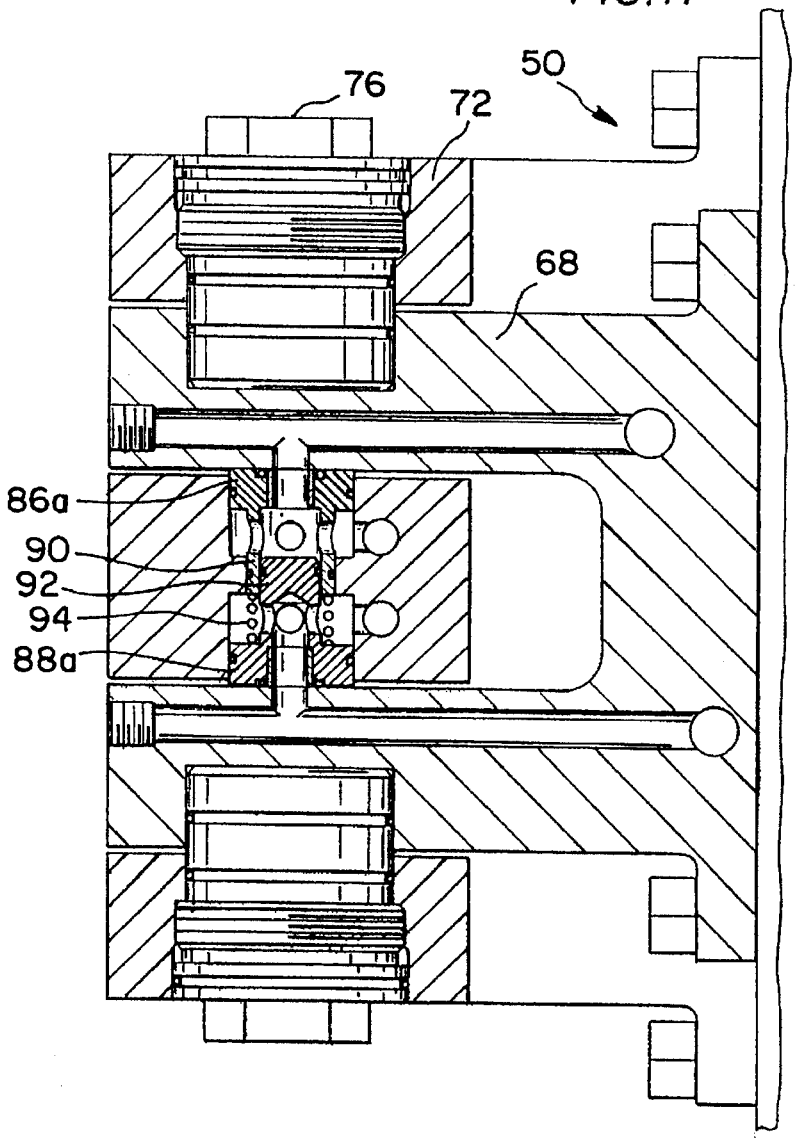
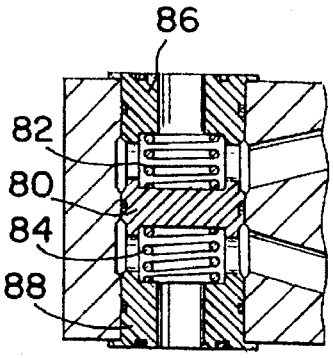
FIG. 10
(PRIOR ART)

FIG. 4A
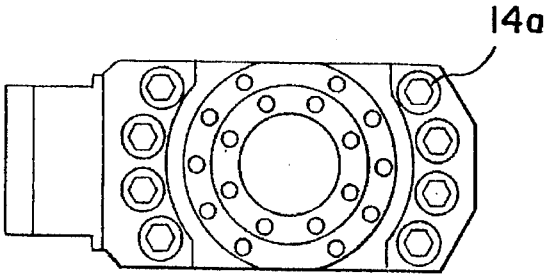
FIG. 4B
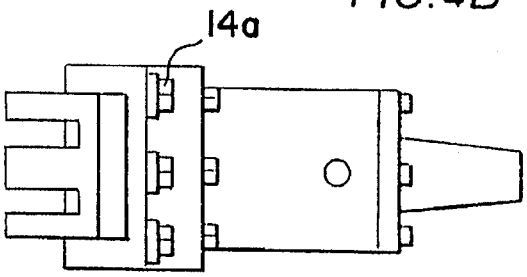
FIG. 5A
FIG. 5B
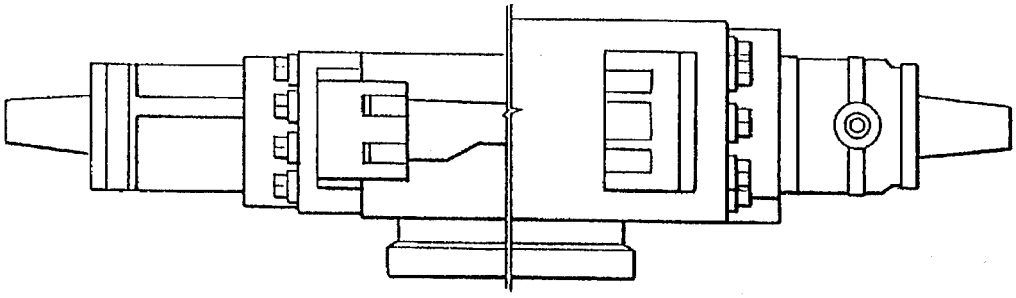
FIG. 6A
FIG. 6B
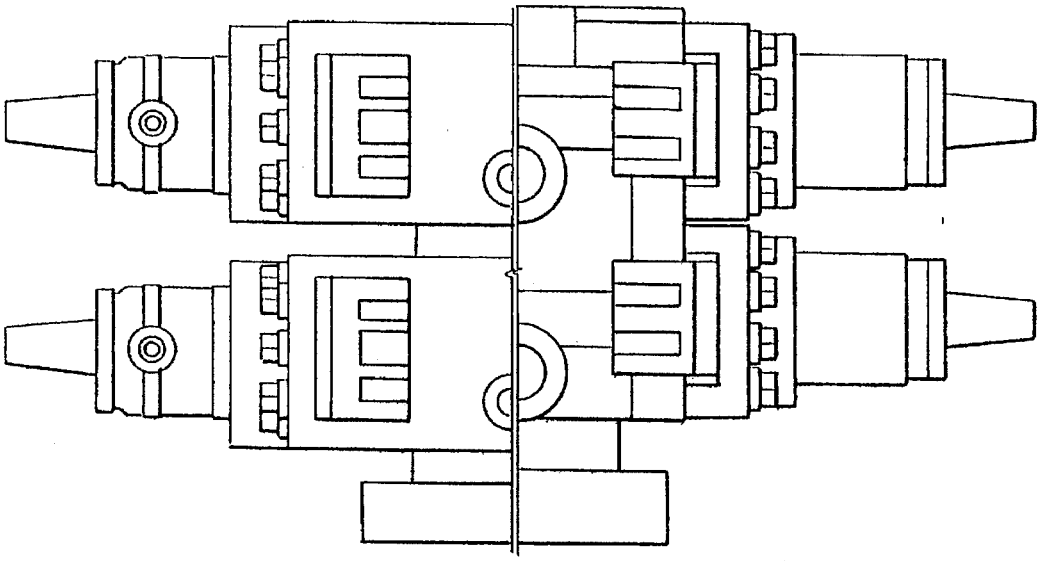

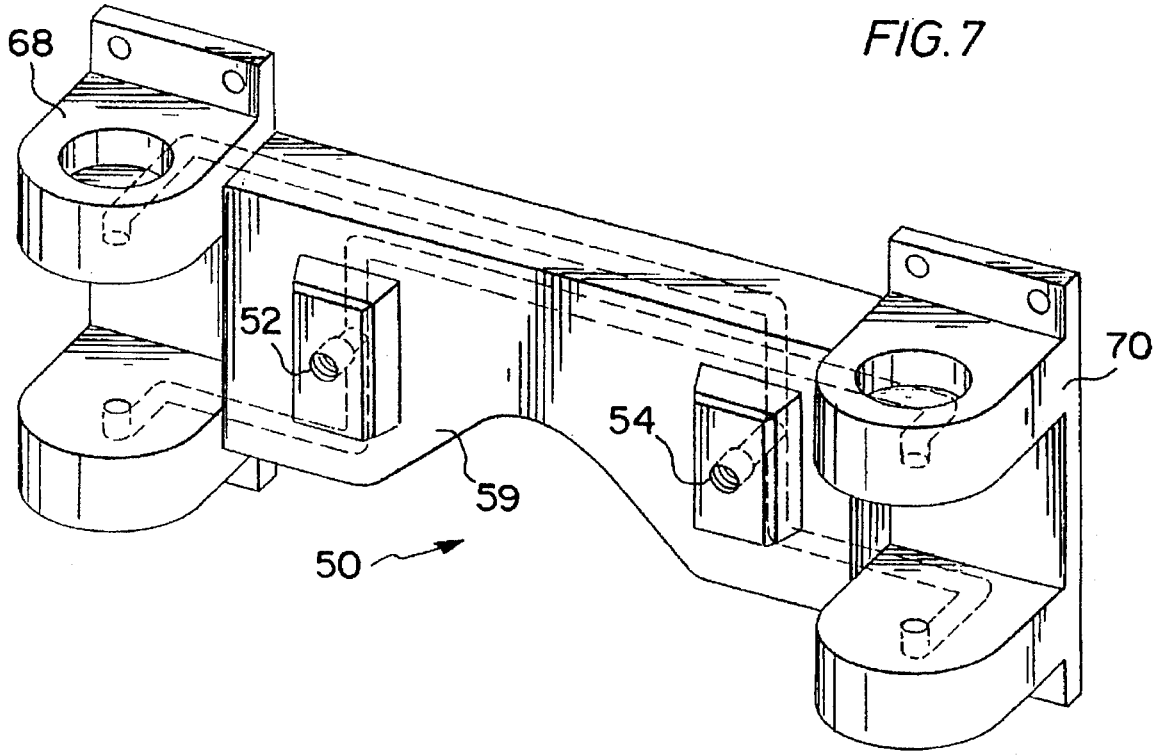
FIG. 7
FIG. 8
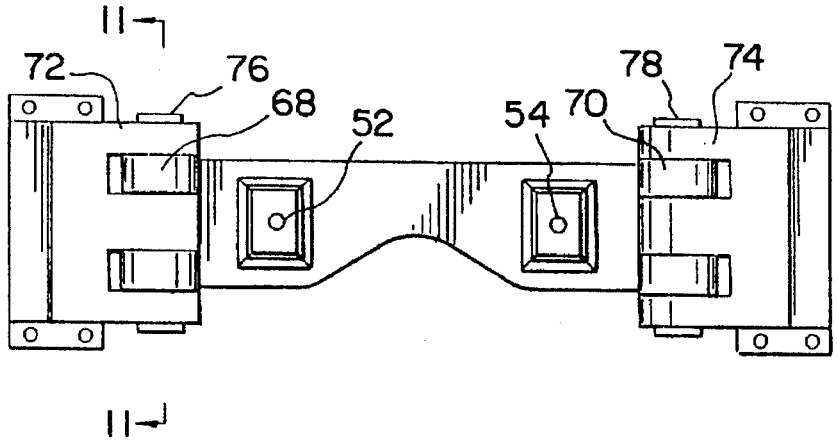
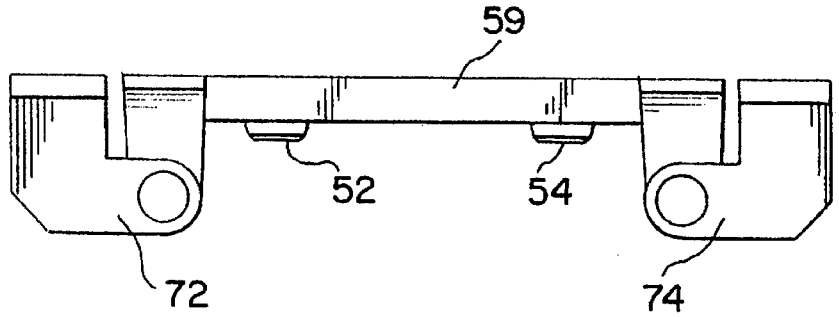
FIG. 9

LOW PROFILE AND LIGHTWEIGHT HIGH PRESSURE BLOWOUT PREVENTER

This application is a division of application Ser. No. 08/372,397, filed Jan. 13, 1995, abandoned.

BACKGROUND OF THE INVENTION

1. Field of the Invention

This invention pertains to pressure vessels and particularly to features of high pressure blowout preventers that allow for the reduction of profile and/or reduction of weight as compared with conventional blowout preventers, without sacrificing or reducing the operating parameters.

2. Description of the Prior Art

Blowout preventers are employed in oil and gas wells as safety devices to ensure that the well bore is closed off in the presence of unexpected high pressures developing down hole. Blowout preventers operate to not only assure personnel safety, but also to prevent tubing and tools and even drilling fluids from being blown out of the well when a blowout threatens.

There are many different kinds of blowout preventers, but one of the most popular types employed in offshore applications where the highest downhole pressures may be encountered is the ram blowout preventer. A ram type blowout preventer is essentially a specialized type of valve that closes off the wellbore through the use of operational rams positioned transverse to the wellbore and which meet at the center when closed to close off the hole. The faces of the rams are equipped with large rubber packers suitably shaped to close around tubing, drill pipe, casing or on each other when the hole through the blowout preventer is open. When the hole through the blowout preventer is not open, then when the rams close, they close off the annulus between the outside of the pipe in the hole and the wellbore. The opening and closing motivating force to the rams is suitably controlled and applied hydraulic fluid pressure.

Ram type blowout preventers meet all kinds of drilling applications and can be used on the land, on offshore platforms and subsea.

The principal housing parts of a blowout preventer are its body and its bonnets. The body is the center part of the housing that includes a center.vertical opening for alignment with the borehole and transverse guideways for permitting ram operation as described above, the guideways being on two opposite sides of the center opening. Since the rams move an appreciable distance in and out, the housing is extended on either side contiguous with the guideways into guideway extensions located in bonnets. Thus, there are two bonnets located on either side of the body.

Bonnets are typically bolted to the body using a plurality of bolts that bolt a flange on the bonnet to the body. The bolts conventionally are pressure torqued to minimize pressure leaks between the body and the bonnet, are located so as to mostly surround the guideway extension, and are located in multiple circular rows. Thus, it is apparent that to remove such a bonnet, pressure tools are required to remove the many highly torqued bolts. It is not uncommon for such removal to take 20–30 minutes. The multiple bolt rows or partial rows and by mostly surrounding the extension guideway of the bonnet necessitate wide flanges. Thus, the heights and the widths of the body and bonnet flanges are appreciable.

It is conventional in some very high pressure applications to stack blowout preventers one above the other. It is known in the prior art to include a stacked arrangement utilizing a single body with two or more sets of guideways, each guideway set is associated with its own pair of bonnets. Such bonnets have been attached as described above, thereby reducing the overall height to be somewhat less than two completely separate blowout preventers. However, the dimensional requirements of the bonnets are the same as discussed above.

Another possible space problem involves how the bonnets are mounted for easy access. Bonnets that are only bolted on are not easy to handle when disassembled. They are heavy and they are difficult to hold in position while the connecting bolts are reinserted and tightened. To alleviate these problems, a hinge has been used to hold a bonnet to the body while the connecting bolts are removed. Although satisfactory in many installations, it is necessary to anticipate the conditions of crowded installations so that the hinge bolt holes on the body can be drilled and tapped on the correct side for accepting the hinge. Otherwise, there may not be enough room to hinge the bonnet properly for ready access.

As previously mentioned, the rams of the blowout preventer are hydraulically operated. The piston drive end of a ram is located in a guideway extension or cylinder portion thereof located in the bonnet. Depending on whether the piston is being driven to close the ram or open the ram, hydraulic fluid is directed to one side or the other of the piston. At the same time that motivating fluid is applied to one side, the other side of the piston has to be ported for evacuating the fluid previously applied thereto. Application of fluid to and from a ram type blowout preventer traditionally is to and from "open" and "close" ports in the body and, from there, through passages in a hinge to the applicable passages in the bonnet. If there is a hydraulic problem, all of the above passageway possibilities exist, including possible problems in the body, which is the least removable or replaceable component of the entire blowout preventer assembly of parts.

In the fluid hinge itself, high power fluid is applied one way or the other depending on whether fluid is being applied to close or open a ram. This applies pressure on the hinge that could cause leakage except for the fact that a balancing system of components are used to insure against leaks and to maintain balanced pressure on the hinge regardless of the applied hydraulic fluid pressure direction. The prior art balancing system typically has utilized two mechanical springs and one or more sealing subs.

Typically, a ram operates within a sleeve present in the guideway extension of the bonnet. Fluid to the "close" side of the piston head of the ram is directed in such a system between the sleeve and the guideway extension. It will be noted that by eliminating such a sleeve and including a passageway for the closing hydraulic fluid within the housing of the bonnet, valuable reduction in overall size of the bonnet can be achieved vis-a-vis the prior art.

It is therefore a feature of the present invention to provide an improved high pressure ram-type blowout preventer that utilizes having a sealing ring around the hydraulic pistons of the rams to reduce the number of bolt holes necessary to connect the body to a bonnet and therefore reduce the weight and profile of the overall blowout preventer without reducing its operating pressure characteristics.

It is another feature of the present invention to provide an improved stacked ram-type blowout preventer that has a simplified bolting connection arrangement to lower the weight and profile requirements therefor compared with a comparable stack of the prior art.

It is yet another feature of the present invention to provide an improved ram-type blowout preventer that has a universal hinge plate that permits the location of hinges on either side of its body for hinging the bonnets to thereby avoid difficulties that would otherwise be encountered because of limited space availability.

It is still another feature of the present invention to provide an improved ram-type blowout preventer that uses a universal hinge plate with internal hydraulic passageways to facilitate maintenance by avoiding having such passageways in the body of the blowout preventer.

It is yet another feature of the present invention to provide an improved ram-type blowout preventer that employs passageways for the application of hydraulic fluid only in the housing of the bonnet and not between a sleeve and a guideway extension to simplify the arrangement of passageways compared with the prior art to thereby reduce the overall size of the bonnet.

SUMMARY OF THE INVENTION

A low profile, lightweight high pressure ram-type blowout preventer is disclosed that includes a pressure axis-positionable-and-radially expansible metallic sealing ring for sealing against pressure leaks through gaps between the body and a bonnet of the blowout preventer. A small plurality of normally torqued connecting bolts are located at a uniform radius or in a single line from the ram axis that operates into and out of the guideway extension in the bonnet. Alternatively, a stack of similar blowout preventers can be provided with a common body having guideways for a multiple set of rams, each bonnet being similarly bolted.

Preferably, a hinge plate is provided With hinge attachments at either end so that it can be located on either side of the body of the blowout preventer for hinging the bonnets, as desired. In some situations, there is ample room to hinge the bonnets for swinging in either direction; however, in other situations, being able to hinge the bonnets as desired is critical to installation. The hinge plate provides porting to hydraulic connections for opening and closing the rams, the passageways for the hydraulic connections leading through the hinge plate to the fluid hinges without also going through the body first. The hinge plate is connected to each of the bonnets so that matching passageways in the bonnets mate with the passageways in the hinge ends of the hinge plate. Thus, if it is desired to have the hinge plate on one side or the other, the assembly of hinge plate and the two adjoining bonnets are merely turned over or upside down. The bonnets and the hinge plate are capable of being mounted either way. If there is a hydraulic passageway maintenance problem, the hinge plate and/or the affected bonnet can be easily repaired and/or replaced without having to perform maintenance on the body. The fluid hinge sub seal structure is also preferably simplified by balancing the pressure through the fluid seal utilizing only one spring and a centralized, telescoping sub.

Finally, the blowout preventer disclosed herein utilizes passageways in the housing of the bonnets to either side of the respective ram pistons. The passageways in the bonnets are located parallel to the guideway extensions or cylinders and between the inside wall of such cylinders and outside surface of the respective bonnets. Thus, the profile of the overall bonnet is effectively reduced for the same operating pressures when compared with ram-type blowout preventers of the prior art that utilize a sleeve within the guideway extension of the bonnet.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof that are illustrated in the appended drawings, which drawings form a part of this specification. It is to be noted, however, that the appended drawings illustrate only preferred embodiments of the invention and are therefore not to be considered limiting of its scope as the invention may admit to other equally effective embodiments.

FIG. 3 is a close up cross-sectional view of area 3 identified in FIG. 2.

FIG. 4A is an end view of a lightweight ram-type blowout preventer in accordance with the present invention.

FIG. 4B is a side view of the preventer shown in FIG. 4A.

FIGS. 5A and 5B represent a side-by-side comparison of a conventional blowout preventer and one of the same pressure capacity in accordance with the present invention.

FIGS. 6A and 6B represent a side-by-side comparison of a conventional dual stack blowout preventer and a lightweight dual stack blowout preventer in accordance with the present invention wherein the lightweight preventer is rated at one and one-half the capacity of the conventional preventer.

FIG. 7 is an oblique view of a hinge plate in accordance with the present invention.

FIG. 8 is a front view of the hinge plate shown in FIG. 7.

FIG. 9 is a top view of the hinge plate shown in FIG. 8.

FIG. 10 is a cross-sectional view of a typical fluid hinge of a blowout preventer in the prior art.

FIG. 11 is a cross-sectional view of a fluid hinge of a blowout preventer in accordance with the present invention.

DESCRIPTION OF THE PREFERRED EMBODIMENT

Figure 1B:
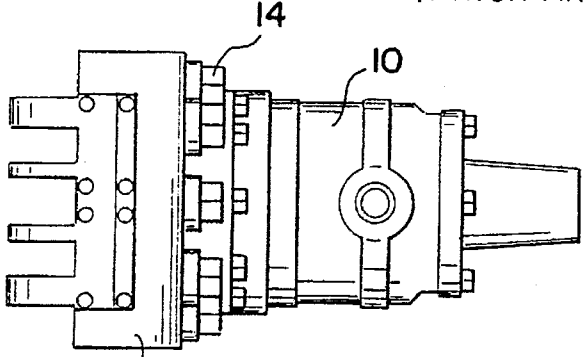
FIG. 1B (PRIOR ART)
FIG. 1B is a side view of the ram-type blowout preventer shown in FIG. 1A.
Figure 1A:
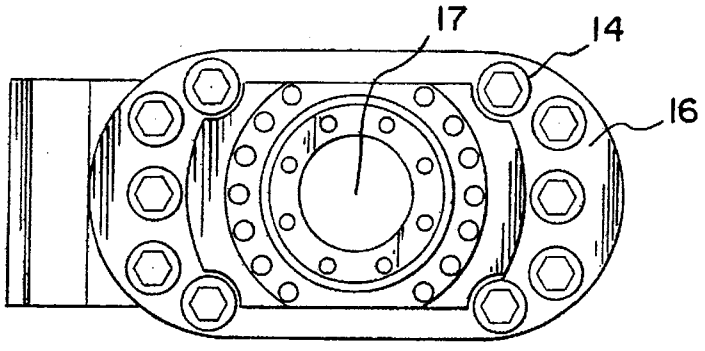
FIG. 1A (PRIOR ART)
FIG. 1A is an end view of a conventional ram-type blowout preventer in accordance with the prior art.

Now referring to the drawings, and first to FIGS. 1A and 1B, a conventional bonnet 10 of a ram-type blowout preventer is shown in an end view and a side view, respectively. The conventional bonnet 10 is connected to body 12 of the blowout preventer by a plurality of connecting bolts 14 through a suitable wide flange 16 on the bonnet. To minimize the height of the bonnet, the flange is elongated on either side, as shown in end view FIG. 1A. That is, a full ring of bolts around the elongate axis of the bonnet, which is also the elongate axis of the ram operating within the bonnet, would require a much larger flange to both sides and above and below the structure illustrated. However, conventional ram-type blowout preventers tend to leak under high pressure conditions in the gap between the body and each of the bonnets, therefore, there are generally at least five connecting bolts on each side of the flange as shown in FIG. 1A. They are located at different distances from center 17 of the elongate axis to accommodate the number of bolts required for a high pressure blowout preventer. The bolts are pressure torqued to minimize and hopefully eliminate leakage of hydraulic fluid between the body and the connected bonnet. All of the above necessitates a heavy construction, which is compared hereinafter with the lightweight construction available as a result of the present invention.

Figure 2:
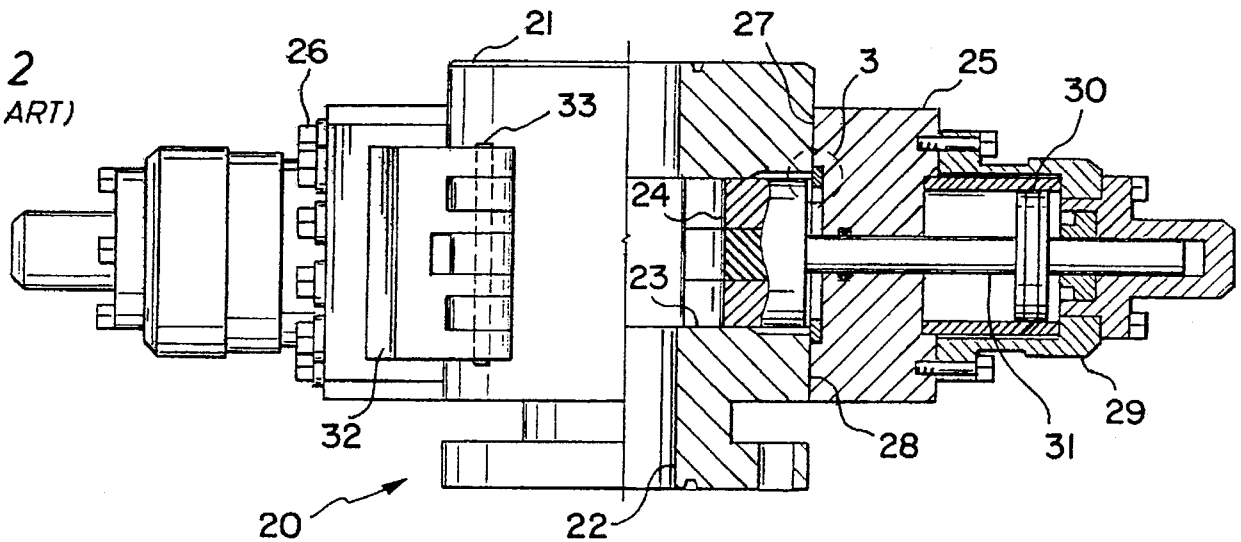
FIG. 2 (PRIOR ART)
FIG. 2 is a side view, partially in cutaway, of a ram-type blowout preventer in the prior art that employs a sealing ring for sealing leaks that would otherwise occur between the body and the bonnet of the preventer.

Now turning to FIGS. 2 and 3, selected illustrations are shown from the blowout preventer described in U.S. Pat. No. 5,255,890, Morrill, issued Oct. 26, 1993 and commonly assigned herewith. The full disclosure is incorporated herein for all purposes; however, so as to permit an understanding of the structure, a brief description is now set forth.

Overall preventer 20 comprises a body 21 having a bore 22 therethrough and means such as a flange on its lower end so that it can readily be installed on the upper end of a wellhead and thereby form an upper continuation of the bore to receive drill pipe or other pipe as it is raised or lowered within the wellhead from and to the well below.

The body has guideways 23 extending from its bore and through the body generally radially opposite one another. A ram 24 is slidable within each guideway (only the right guideway is shown) for movement between an inner or closed position and an outer or open position. The outer end of each guideway is adapted to be opened and closed by means of a bonnet 25, similar to bonnet 10 of FIG. 1B, releasably connected to the body by means of threaded bolts 26, similar to bolts 14 described in connection with FIGS. 1A & 1B. When the bonnet is so connected, its inner face 27 is sealed with respect to an outer face 28 on the body which surrounds the outer end of guideway 23 so as to contain fluid pressure within the preventer.

The rams are adapted to be moved between open and closed positions by operating means including a cylinder 29 mounted on the outer side of the bonnet 25, and a piston 30 sealably reciprocal in the cylinder and having a rod 31 which extends through a hole in the bonnet to connect with the ram 24. Thus, in a manner well-known in the art, hydraulic fluid may be selectively introduced to and exhausted from opposite sides of the piston 30 in the cylinder 29 for selectively moving the ram between its open and closed positions.

A hinge 32 connects the bonnet to the body for swinging about hinge pin 33 between open and closed positions when it has been disconnected from the body by backing off the bolts 26. The outer end of the guideway is suitably enlarged to permit the ram to move freely into and out of the guideway when the ram is in its outer open position.

Now referring to FIG. 3, inner face 27 of each bonnet has an annular recess formed therein which, as shown, is cylindrical, but which may be of other configuration, such as oval. The recess has a peripheral wall 34 and an end wall 35 which is opposite the outer face 21A of the preventer body, and a seal assembly, including a metal ring 36, is mounted in the recess for limited axial and radial movement within the recess. More particularly, the assembly also includes a first elastomeric ring 37 which is received in a groove 38 about the inner side of the metal ring for engaging the outer face 21A of the body. As shown, the seal ring is an O-ring having a diameter greater than the depth of the recess so as to protrude therefrom, and a wavy spring 39 is received within a groove 41 about the outer side of the metal ring in position to be axially compressed between the bottom of the groove and end wall 35 of the bonnet recess, whereby the metal ring is urged inwardly toward the body face 21A so as to compress seal ring 37 between the face and bottom of the groove in the metal ring.

As previously described, the assembly also includes another elastomeric seal ring 40 which is received in a groove 41 about the outer circumference of the metal ring opposite the peripheral wall 34 of the recess. As shown, this ring 40 is also an O-ring and has a diameter greater than the depth of the groove 41 so as to protrude therefrom and thus sealably engage the wall 34. There is also a back-up ring 40A in the groove 41 on the inner side of seal ring 40.

Of course, the seal rings 37 and 40 may be other than O-rings, such as lips arranged to face the internal pressure. Also, means other than the wavy spring 39, such as an O-ring may be compressed axially between the groove and end wall of the recess, may be used to initially urge the inner side of the metal ring against the outer face 21A.

As best shown in FIG. 3, the O-ring 40 sealably engages the peripheral wall of the recess about an area greater than the area with which the seal ring 37 sealably engages the face 21A of the preventer body. Hence, fluid pressure in the guideway of the preventer is effective to urge the metal ring inwardly against the face 21A with a force equal to that pressure times an annular area equal to the difference between the outer diameter of the O-ring 40 and the sealing diameter of the seal ring 37.

At the same time, since the O-ring 40 sealably engages the cylindrical wall 34 outwardly from the preventer body face 21A that is sealably engaged by the O-ring 37, the metal ring is urged radially outwardly toward the wall 34 by a force equal to the internal pressure times an annular area intermediate the sealing engagement of O-ring 37 with face 21A and the sealing engagement of O-ring 40 with wall 34. More particularly, as is previously described, the ring is of such size and shape that the internal pressure will force the inner side of the metal ring tightly against the outer face of the body prior to radial expansion of its periphery against the peripheral wall of the recess.

The selection of the shape of the ring as well as the above described annular sealing areas for accomplishing this object would be obvious to a person skilled in the art. Thus, for example, the metal ring should not be so thin relative to its length as to be too stiff in an axial direction to conform to the outer face of the preventer body, or to lack sufficient stiffness radially to cause its outer periphery to engage the peripheral wall of the recess too soon and thus lock it within the recess prior to axial movement of its inner side against the face 21A of the body. In like manner, the metal ring should not be so thick in a radial direction as to prevent its outer periphery from conforming to the peripheral wall, following conforming of its inner side against the outer face of the body, so as to close gaps through which seal ring 40 might extrude. A further consideration, of course, is the location of the seal ring 40 so as to provide an annular area over which internal pressure acts to provide the force necessary to fully expand the metal ring.

As shown on the drawings, the areas $A_f$ and $A_o$ are respectively the unbalanced area of the seal face of the ring and the unbalanced area about the outer periphery of the ring. The minimum area $A_o$ for a given $A_f$, in order to accomplish the purposes just described, may be calculated in accordance with the following equations, wherein:

P=Internal blowout preventer pressure $P_c$=Pressure to overcome ring stiffness $P_f$=Pressure to overcome frictional resistance between inner end of ring and outer face of preventer body $P_c$=Internal blowout pressure at which ring is expanded to close the gap (The gap is usually 0.005" or more with the ring at rest.)

$F_o$ =Reaction force on the face $A_o$ $F_f$=Reaction force on the face $A_f$

μ=Assumed coefficient of friction

N=Safety factor.

Expansion of the ring into contact with the peripheral wall of the cavity 34 is resisted by the stiffness of the ring plus the frictional sliding force of the ring against the outer face 21A of the body. The pressure $P_c$ and $P_f$, and the pressure $P_f$ for overcoming frictional resistance equals $\mu F_f/A_f$.

$$F_f=P_c(A_f)$$

so that, by substituting:

$$P_f=\mu(P_c),$$

$$P_c=P_c+\mu(P_c)$$

Consequently:

$$P_c=P_c/(1-\mu).$$

In the case of a circular ring, $P_c$ is found by solving the equation for expansion of an open end, thick-walled cylinder (see Roark, *Formulas for Stress and Strain*). As is well-known in the art, the equation for a non-circular ring will involve additional factors.

Thus, the force required to expand the ring into contact with the peripheral surface of the cavity equals $P_c(A_o)$, and the sum of forces $F_o$ in the radial direction is $P(A_o)-P_c(A_o)$, wherein, as above noted, $F_o$ is the reaction to the pressure-induced force of the ring on the peripheral wall upon contact.

Using the safety factor N, the desired relationship of the forces on the axial direction is $$P(A_v)=N(\mu)(F_o)$$

Substituting for $F_o$:

$$P(A_o)=P(A_f)/N(\mu)+P_c(A_o).$$

Solving for the desired area ratio:

$$A_f/A_o=N(\mu)(1-P_c/P)$$

The area ratio calculated from this equation is a minimum value. Once $A_f$ has been determined, this equation allows the calculation of the maximum value for $A_o$ for dependable functioning of the bonnet seal ring. These equations hold for both circular and non-circular seal rings.

The metal ring 36 is mounted on the bonnet by a pair of spaced-apart bolts 42 which extend through holes 43 in the ring and which are threadedly connected at their inner ends to threaded sockets in the end wall of the recess. As shown, the holes 43 are substantially larger than the diameters of the bolts 42 so as to permit limited radial movement of the metal ring with respect to the bolts, as may be necessary to enable the metal ring to be forced radially outwardly by internal pressure, as previously described.

The metal ring is retained on the bonnet by an enlarged head 44 received in a recess 45 on the inner side of the metal ring. Thus, as shown, the heads 44 are larger than the holes 43. On the other hand, there is sufficient Space between the enlarged heads 44 and the inner ends of the recesses 45 to permit movement in accordance with the above description.

It has been discovered through the use of the metal ring structure in conjunction with the ram, that so effective is the leak prevention, fewer connecting bolts than heretofore believed possible can be safely employed to connect a bonnet to the body of a preventer for the same pressure operation. It has been determined, for example, that as few as eight connecting bolts 14*a*, four to a side when looking at the end of the bonnet, are a sufficient number to bolt the bonnet in place to the body. See, for example, FIGS. 4A and 4B. Moreover, placing the bolts at the same radius distance from the center is also satisfactory because of the lesser number of bolts than previously required in the prior art. Alternatively the bolts on each side can be placed in a line. See, for example, FIG. 13. Finally, the bolts do not have to be highly torqued in an attempt to minimize pressure leaks in the gap between the body and the bonnet since the pressurized metal ring structure discussed above satisfactorily minimizes or eliminates undesirable leakage. Ordinary torquing in the vicinity of less than 2000 ft.-lbs. is satisfactory. The bolts themselves can be larger in diameter, but there is a saving in overall weight because of bonnet flange size reduction reduces the overall weight by as much as 20–25%. Also, the profile is reduced in size. The reduction of the flange size has the further beneficial effect of reducing the overall stresses in the preventer and, therefore, allows more efficient use of materials overall. A comparison of a conventional ram blowout preventer (FIG. 5B) with the same ram operator is shown with the lightweight blowout preventer (FIG. 5A) just described.

As previously mentioned, preventers are also made in a stacked configuration wherein two or more ram operators are located operating within respective guideways of the same body. Another way of illustrating the great savings effected by the arrangement discussed above is illustrated in FIGS. 6A and 6B, wherein a lightweight 18¾"–15,000 psi dual ram-type blowout preventer is shown on the right side in FIG. 6B compared with a conventional 18¾"–10,000 psi ram-type blowout preventer shown on the left side in FIG. 6A. In both cases, the approximate weight of the dual preventer is 49,000 pounds. The conventional dual stack is 73.2 inches high compared with the overall height of the lightweight dual stack that measures 75.0 inches. This means that for about the same weight and height, the capacity of the preventer stack has been increased by 50%. This becomes very important with respect to material handling considerations as well as installation situations. For example, the same material handling equipment conventionally able and available for handling the conventional 10,000 psi dual stack can now be used for handling the 15,000 psi dual stack of the lightweight design. The same support structure can be used and the same room or space conditions will accept either the 10,000 psi dual stack of conventional design or the 15,000 psi dual stack of the lightweight design. Thus, available platforms and the like can be used with drilling situations that drill into the deeper and higher pressure zones.

Now referring to FIGS. 7–9, a further convenience for use with the new lightweight designed blowout prevent is shown in hinge plate 50. Hinges, even fluid hinges that include fluid passageways, have been employed in the prior art for connecting bonnets to the body of a blowout preventer. However, the passageways for opening and closing hydraulic fluid have heretofore been to the body, through the hinge, through the bonnet, to the ram pistons. By having a hinge plate with a manifold construction, passageways do not have to be included in the body. Instead, the hinge plate itself becomes a manifold for the passageways leading to the hinges. That is, the opening and closing ports 52 and 54, respectively, for attachment to the opening and closing hydraulic lines (not shown) are included in the hinge plate. The passageways are conveniently drilled and plugged in body portion 59 of the hinge plate and in hinge portions 68 and 70. That is, the passageways shown in dotted sections heading from parts 52 and 54, respectively, are straight passageways with 90° bends that are drilled from the most convenient end, top or front surface of the hinge plate and then plugged so that the operating passageways, as shown, remain as the manifold connections. The passageways in plate hinge portions 68 and 70 lead to passageways in bonnet hinge portions 72 and 74, respectively.

It will be seen in FIG. 8 that each bonnet hinge section includes three arms so as to surround the two arms of the plate hinge section. The arms are held in place by a vertical bolt 76 or 78 in much the same fashion as used on common door hinges. The center arm of the bonnet hinges, in addition to including suitable ports or passageways, also include a suitable balancing sub, as shown in FIG. 11.

Hinges in the prior art have included a balanced sub arrangement as typified by FIG. 10. In such prior art fluid hinge, a central sub 80 with a spring 82 and a spring 84 located on either side provide a mechanical loading to outward seals 86 and 88, respectfully. These outward seals include a passageway therethrough and appropriate O-rings to urge the seals against the faces of the adjoining hinge arm in sealing relationships regardless of whether the opening hydraulic fluid or the closing hydraulic fluid is being applied. The change of pressure on the side of central sub 80 causes an unbalanced condition that is made up for by the pressure of springs 82 and 84 and the pressurizing of sub 80 to prevent the fluid hinge from leaking.

It has been found, however, in the design employed in conjunction with hinge plate 50, and as shown in FIG. 11, that a sub made up of an outer sub 90 that telescopes about inner sub 92 operates satisfactorily with only one spring 94 applied to bias against both sub sections. The fluid applied on both sides is under pressure, howbeit the pressure changes depending on whether opening or closing pressure is applied. Nevertheless, it is the combined pressure of spring and fluid that causes the necessary outward pressures of seals **86*a* and 88*a*, which are essentially the same as in the prior art. Since there is only one spring, precision balancing of two springs is avoided. The hydraulic fluid pressure merely makes up the difference in the balancing pressure required by moving either or both telescoping sections 90 and 92** of the sub.

Hinge plate 50 provides the capability of hinging both bonnets on the same side, but that hinging can be selected to be on either side. Thus, if there is insufficient room or access to hinge the bonnets on one side in a particular installation, the connecting hinging can be easily provided by installing the plate and the bonnets on the opposite side of the body. Moreover, in a stack arrangement, the bonnets on the body operating with a first ram pair can be conveniently hinged on one side while the bonnets operating with a second ram pair can be conveniently hinged on the opposite side or on the same side, as selectively desired. Hinge plate 50 includes the open and close connecting passageways to the bonnets, as conveniently shown in FIGS. 7 and 12. The hinge plate and bonnets are conveniently made to be reversible so that when mounted on a first side of the body the "top" of the hinge plate and bonnets are located on the same side as the top side of the body. However, when the hinge plate and bonnets are mounted on the other or second side of the body, the assembly is upside down from its first orientation so that the "top" of the hinge plate and bonnets are now located on the "bottom". Actually, neither the "top" nor the "bottom" of the hinge plate and bonnets are designated top or bottom since these assemblies are completely bidirectional. It is apparent that only one close passageway set and one open passageway set is required for both the hinge plate connecting passageways and the passageways in each of the bonnets because of this reversibility.

Finally, the hydraulic fluid passageways in the bonnets are conveniently located in the housing of the bonnet at locations on either side of the pistons for the respective rams. In the prior art, it has been conventional that one passageway passes between a sleeve within the guideway extension and the inside surface of the guideway extension to the closing side of the piston head. However, by having the hydraulic passageways in the housing of the bonnet alongside the guideway extensions and between the internal walls of the guideway extensions or cylinders and the outer surface of the bonnet housing, the design is not only simplified, but less material is required for the body than in the prior art. By avoiding a sleeve, potential cumbersome maintenance problems are eliminated.

Figure 12:
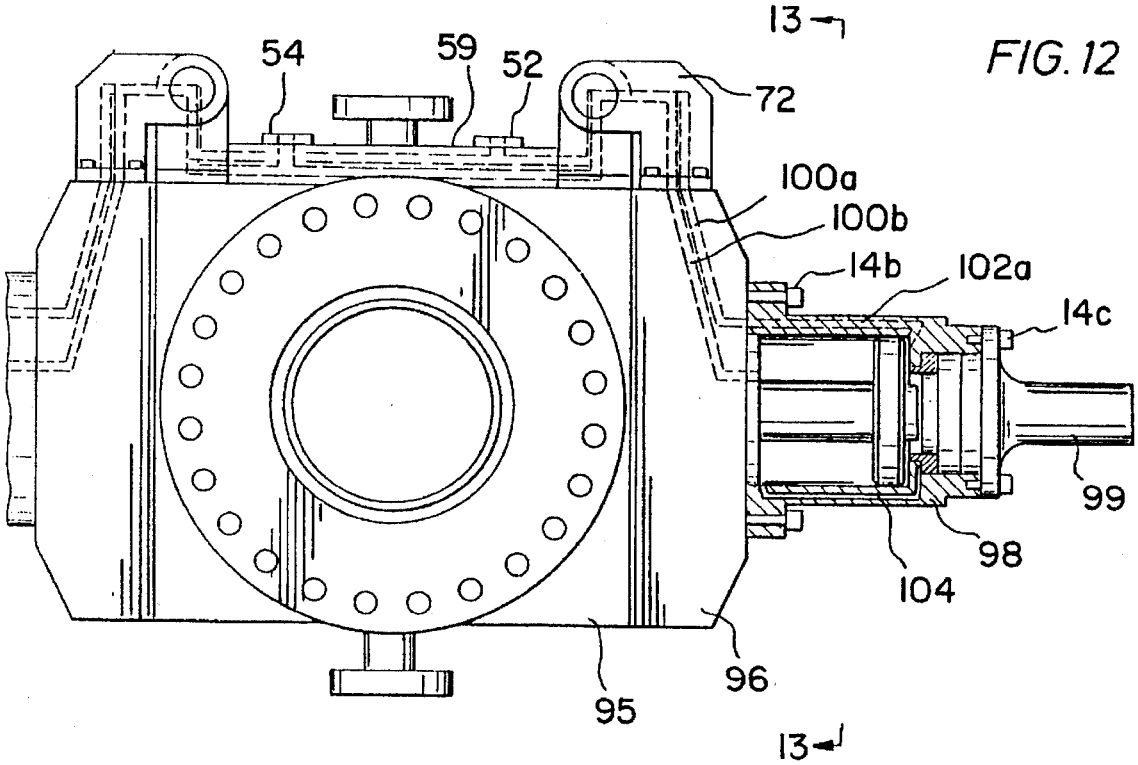
FIG. 12 is a blowout preventer in accordance with the present invention illustrating passageways in the hinge plate and in the bonnet housing.
Figure 13:
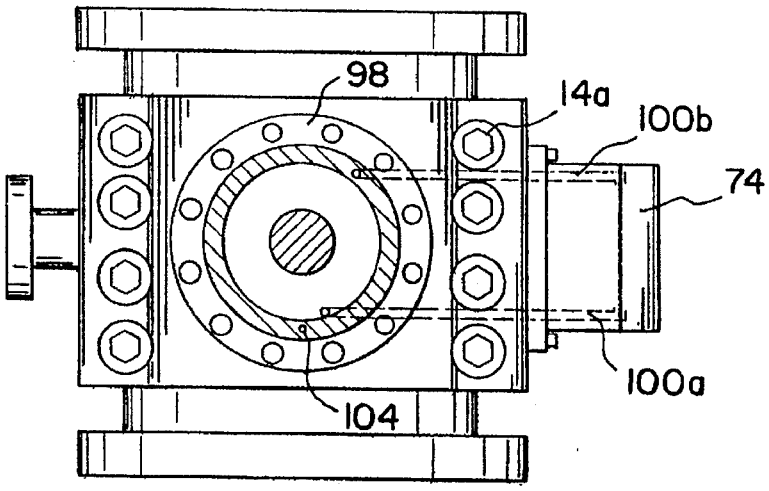
FIG. 13 is a cross sectional view taken at line 13—13 of FIG. 12.

A partial passageway drawing is shown in FIG. 12, wherein hinge plate 59 previously discussed is shown bolted to body 95 of a blowout preventer. As shown by the dotted lines in the hinge plate, opening hydraulic port 52 and closing hydraulic port 54 are connected to appropriate passageways down the hinge plate and through fluid hinge section 72, which is part of bonnet 96. Bonnet 96 is conveniently made in multiple parts that includes a section that is attached directly to body 95 via bolts not shown in FIG. 12 but are shown in FIG. 13, an intermediate section 98 that is bolted to the first section via bolts 14G, and a bonnet cap 99 that is bolted to the intermediate section in bolts 14C.

Figure 14:
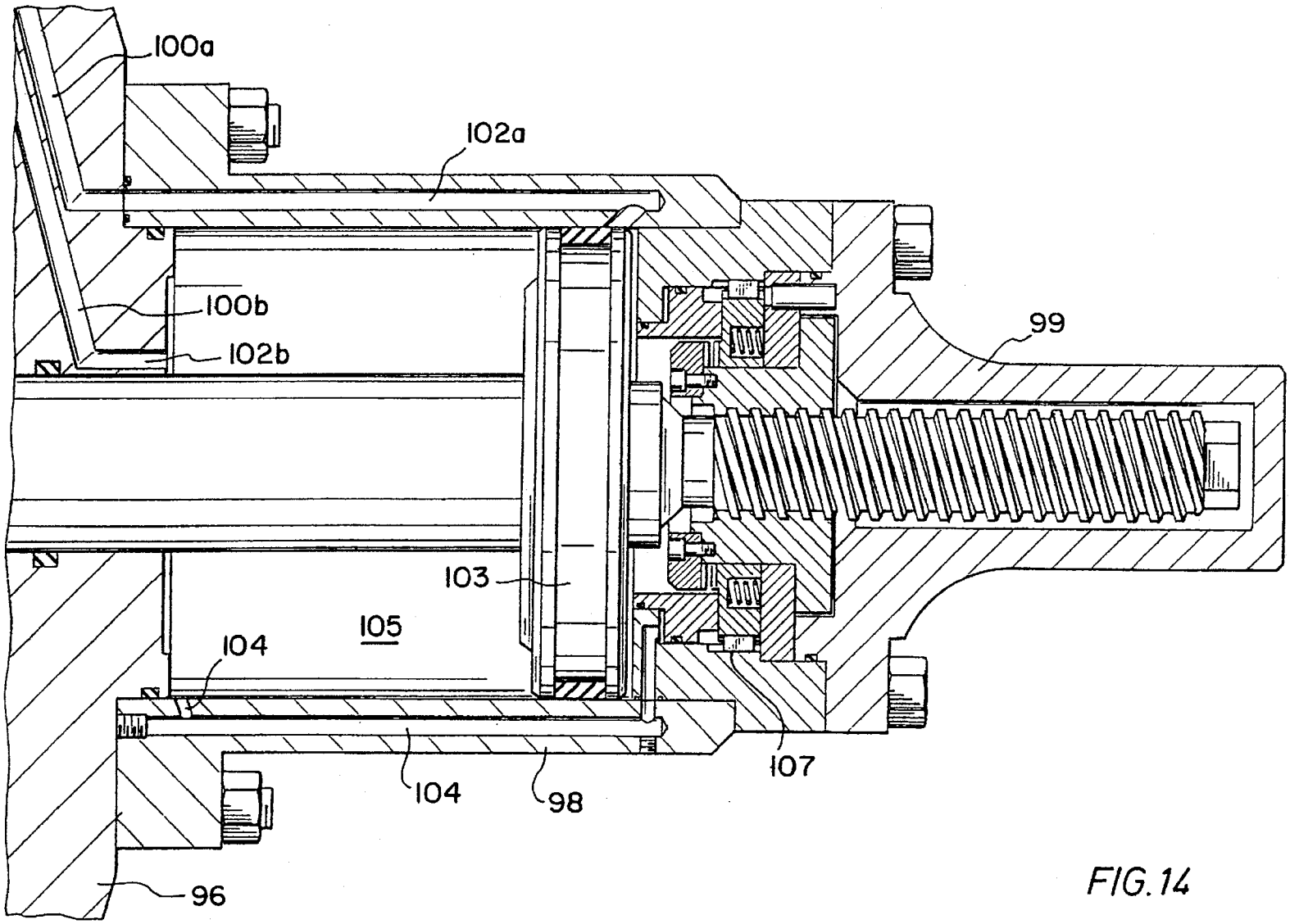
FIG. 14 is a close-up lateral cross sectional view of the bonnet housing passageways for the embodiment shown in FIG. 12.

In any event, passageways **100*a* and 100*b* within the bonnet leads from the fluid hinge. Passageway 100*a*, which is shown in FIG. 12 more to the right than passageway 100*b*, joins closing passageway 102*a*. Passageway 100*b*, which is parallel to passageway 100*a* in FIG. 12, joins opening passageway 102*b*. In actual practice, these two passageways are on the same line as viewed in FIG. 12, but they are shown slightly separated for viewing convenience. The open space portion of the cylinder or guideway extension 105 shown in FIG. 14 in which piston head 103 operates is open to passageway 104. Passageway 104 preferably first leads to ram lock 107**, which is part of the assembly of parts within the bonnet, as explained in U.S. Pat. Nos. 4,052,995 and 4,290,577, both commonly assigned with the present application.

An inspection and preventive maintenance program of the conventional prior art blowout preventers with respect to the low profile, lightweight blowout preventer disclosed herein reveals that there is a vast savings in expected down time of the low profile, lightweight preventer. It is believed that this savings is primarily because of the improvement in design of the hinge plate including a hydraulic manifold, the ease of disassembly and re-assembly of the bolts to the bonnets, and the ease of replacement of elastomers and wear surfaces as a result. It is anticipated that the low profile, lightweight preventer will result in an average downtime savings each year of over 24 hours and will require one less major overhaul during a 12-year period. A major overhaul encompasses complete disassembly of the stack on the rig and shipment to a shop for weld repairs, stress relief and machining, which can easily consume 2–3 weeks.

While several features of the invention have been shown in the preferred embodiments illustrated, it will be understood that the invention is not limited thereto. Many modifications may be made and will become apparent to those skilled in the art.

What is claimed is:

1. The method of preparing a housing for a ram-type blowout preventer for an oil or gas well for use where there is limited contiguous lateral available space, which comprises providing a body with a central vertical opening for allowing the presence of drilling or production tubing therethrough, said body also including a pair of opposing guideways transverse to said vertical opening for the operation of a pair of rams to close and open said vertical opening, providing a first bonnet for being bolted on a first side of said body and a second bonnet for being bolted on a second side of said body opposite said first side, each of said bonnets including a guideway extension contiguously in line with one of said opposing guideways for respectively accommodating the drive end of one ram of said pair of rams, and providing a hinge plate spanning a selected side of said body to provide for hinging said first and second bonnets to said body so as to allow each of said bonnets to be unbolted and swung in a direction toward said hinge plate.

2. The method in accordance with claim 1, and including providing said hinge plate with a plurality of passageways connecting the application of opening and closing hydraulic fluid to said bonnets through the hinge portions of said hinge plate.

3. The method in accordance with claim 1, and including providing said hinge plate and each said first and second bonnets with uniform dimensions so as to be capable of being inverted for selectable attachment to either of two opposite sides of said body.

* * * * *